US005988928A

United States Patent [19]

Cheng

[11] Patent Number: 5,988,928

[45] Date of Patent: Nov. 23, 1999

[54] FOLDABLE JOINT OF A PLAYPEN

[76] Inventor: Ching-Wen Cheng, 3rd Fl., No. 100, Wenlin N. Rd., Peitou Dist., Taipei, Taiwan

[21] Appl. No.: 09/158,137

[22] Filed: Sep. 22, 1998

[51] Int. Cl.[6] ..... F16C 11/10; A47D 7/01

[52] U.S. Cl. ..... 403/102; 5/99.1; 16/324; 403/325

[58] Field of Search ..... 5/99.1, 98.1, 93.1; 403/102, 325, 100; 16/324

[56] References Cited

U.S. PATENT DOCUMENTS 5,474,404 12/1995 Chien ..... 403/102
5,803,650 9/1998 Wu ..... 403/102

FOREIGN PATENT DOCUMENTS 412 070 A1 2/1991 European Pat. Off. ..... 5/99.1

*Primary Examiner*—Alexander Grosz
*Attorney, Agent, or Firm*—Bacon & Thomas

[57] ABSTRACT

A foldable joint of a playpen comprises a U-shaped body having an opening defined in a side face thereof; two linkages respectively pivotally mounted on each end of the body by pivots each having a plug forming a plane on the bottom of the plug provided in the end mounted on the body; and a first spring disposed between the plug and the pivot; a locking means of which the front portion corresponds to the opening, movably mounted in the body by rivets having two wings respectively formed on both sides of the locking means; and a second spring disposed between the back portion of the locking means and the inner wall of the body.

3 Claims, 4 Drawing Sheets

FOLDABLE JOINT OF A PLAYPEN

BACKGROUND OF THE INVENTION

1. Field of the Invention

The present invention relates to a foldable joint of a playpen, and more particularly to a foldable joint which is convenient to operate and reduces the cost.

2. Description of Related Art

A conventional joint of a playpen comprises a body, two linkages pivotally mounted on the body and a locking means. To fold the playpen, the locking means is pressed to unlock the linkages so that the linkages can be rotated. However, when opening a folded playpen, a user has to press the locking means to release the engagement between the locking means and the linkages with one hand before rotating the linkages with the other hand. It is quite inconvenient to fold the playpen with two hands working at the same time. Furthermore, this structure of the joint is complex as the number of elements is large, so the cost of the playpen is expensive.

A foldable joint of a playpen in accordance with the present invention tends to mitigate and/or obviate the aforementioned problem.

SUMMARY OF THE INVENTION

The main object of the present invention is to provide a foldable joint of a playpen which is easy to operate.

Another object of the present invention is to provide a foldable joint of a playpen which reduces the cost.

Other objects, advantages and novel features of the invention will become more apparent from the following detailed description when taken in conjunction with the accompanying drawings.

DETAILED DESCRIPTION OF THE PREFERRED EMBODIMENT

Figure 1:
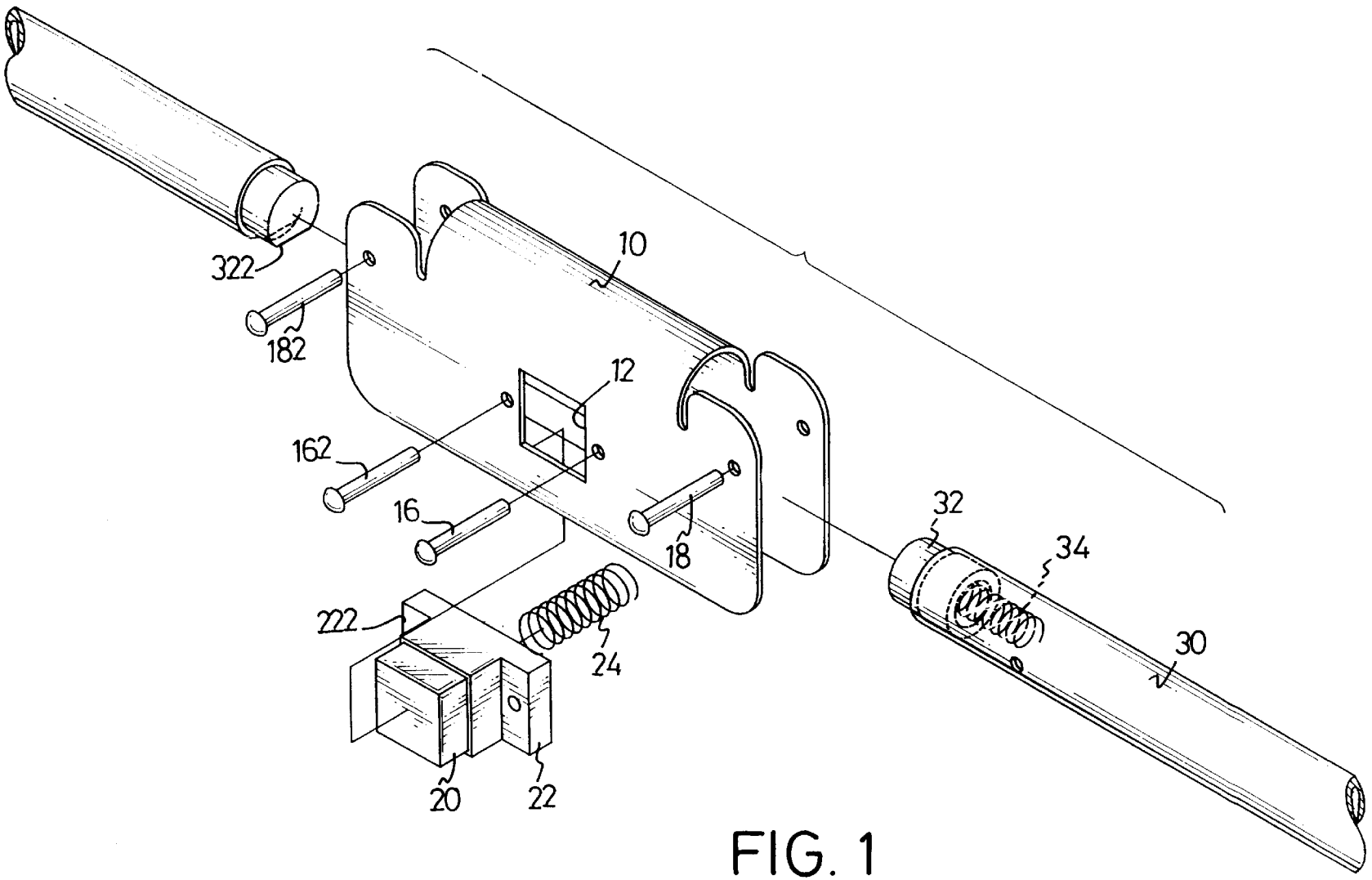
FIG. 1 is an exploded view of a foldable joint of a playpen in accordance with the present invention.
Figure 2:
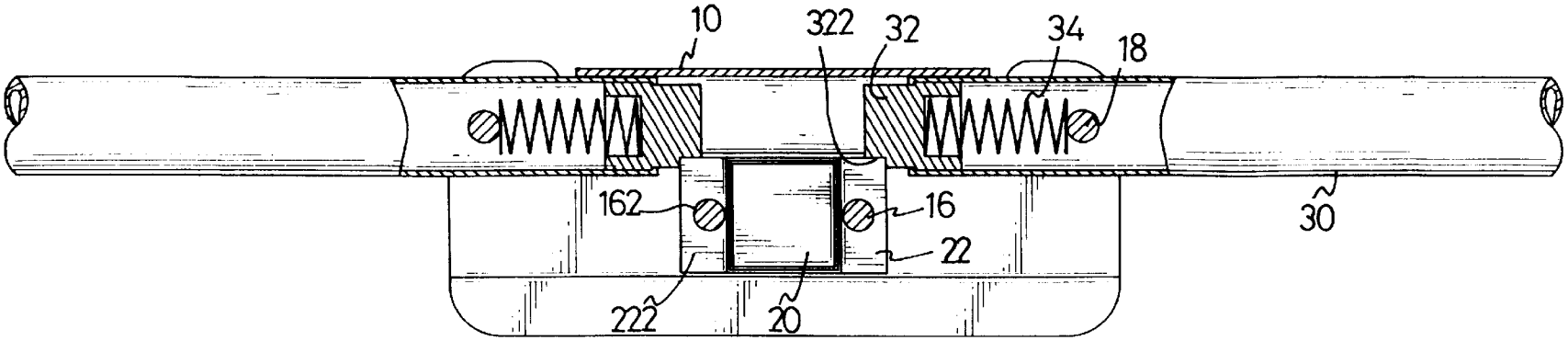
FIG. 2 is a partial sectional view of the foldable joint of a playpen of the present invention.

Referring to FIG. 1 and 2, the foldable joint of a playpen according to the present invention has a U-shaped body (10) defining an opening (12) in a side face and a channel (14) longitudinally through the other side face. Two linkages (30) are respectively pivotally mounted on each end of the body (10) by pivot pins (18, 182). The linkages (30) provide plugs (32), each forming a plane (322), in the ends mounted on the body (10). A first spring (34) is disposed in the linkage (30) between the plug (32) and the pivot (18).

A locking means (20) is mounted in the body (10) by rivets (16, 162) and can be transversely moved along the rivets (16, 162) with respect to body (10). The front portion of the locking means (20) corresponds to the opening (12). The locking means (20) forms two wings (22, 222) respectively on the both sides of the locking means (20). The wings (22, 222) are received in the channel (14) of the body (10).

Figure 3:
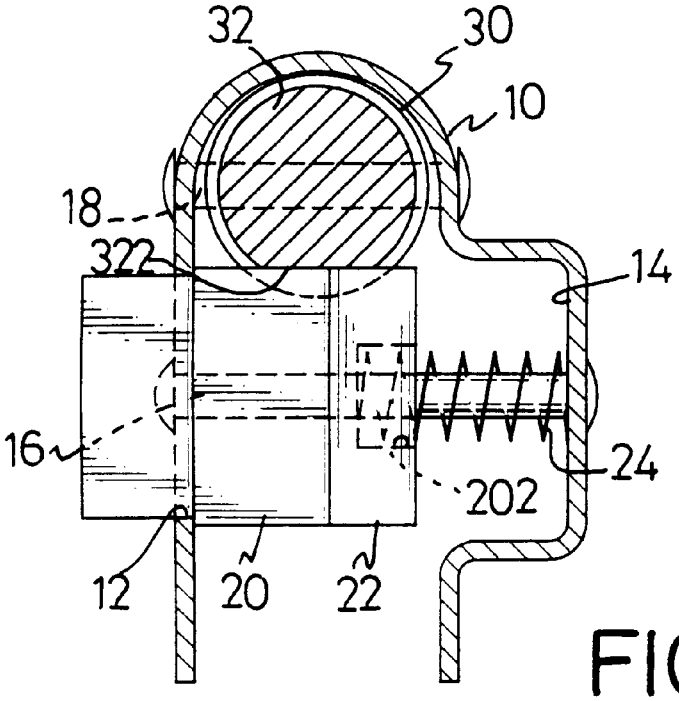
FIG. 3 is a sectional side view of the foldable joint of a playpen of the present invention.

Referring to FIG. 3, the locking means (20) defines a cavity (202) in the back thereof. A second spring (24) is received in the cavity (202) and outwardly pushes the locking means (20).

FIG. 2 shows the "opened" state of the playpen. The locking means (20) is moved outward by the second spring (24), as shown in FIG. 3. The plane (322) of the plug (32) are stopped by the wings (22, 222) of the locking means (20) so that the linkages (30) are held horizontally.

Figure 5:
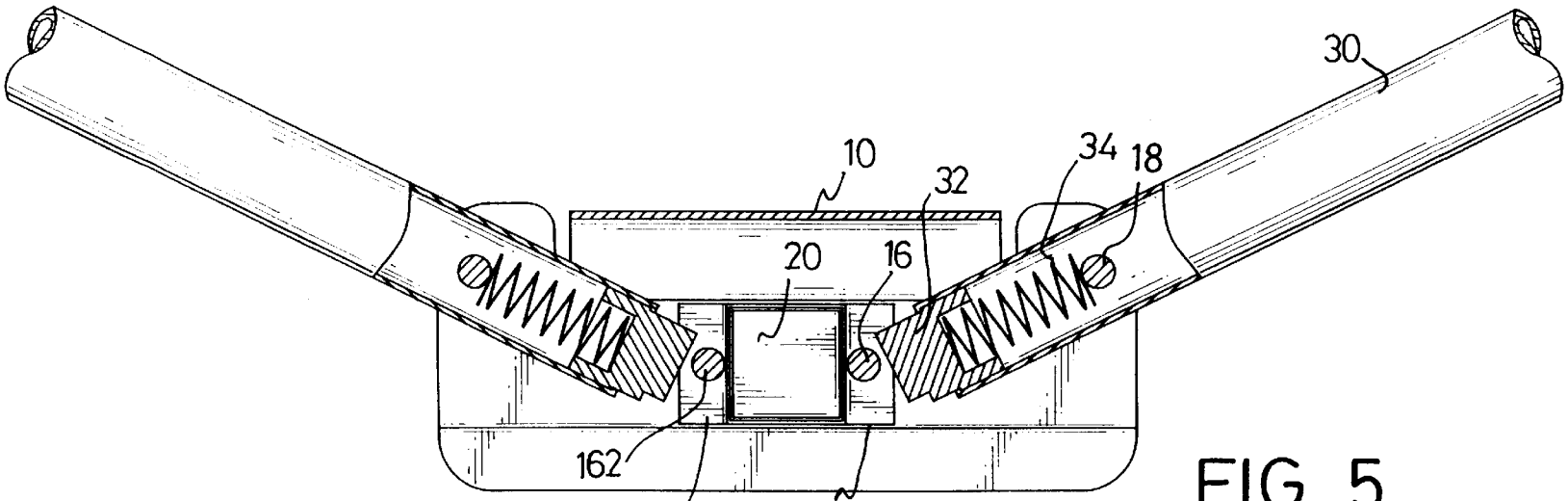
FIG. 5 is a partial sectional view showing linkages of the joint being rotated.
Figure 4:
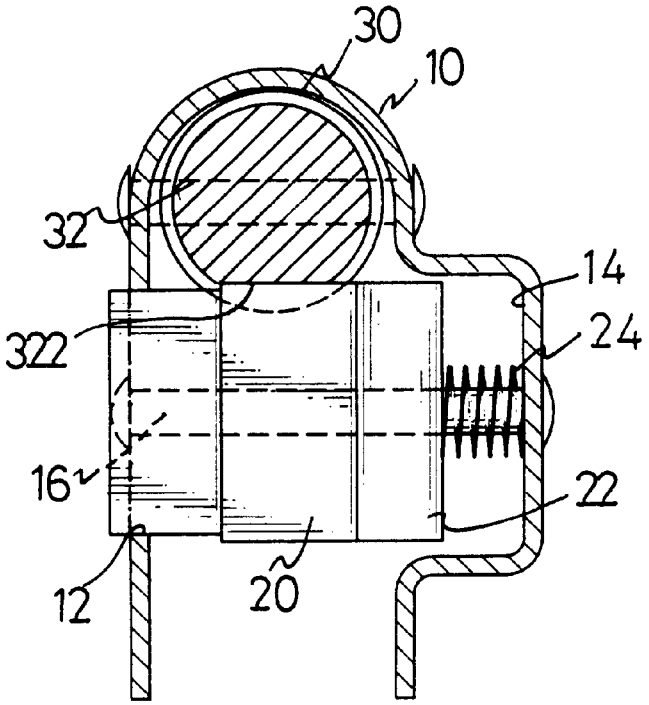
FIG. 4 is a sectional side view showing the locking means of the joint being pressed.

FIG. 4 and 5 show the linkages (30) being folded. With pressing the locking means (20) inward, the wings (22, 222) no longer support the linkages (30). Thereby, the linkages (30) can be rotated downward about the rivets (18, 182) to fold for storing. After that, the locking means (20) will be restored to its original position by the second spring (24).

Figure 6:
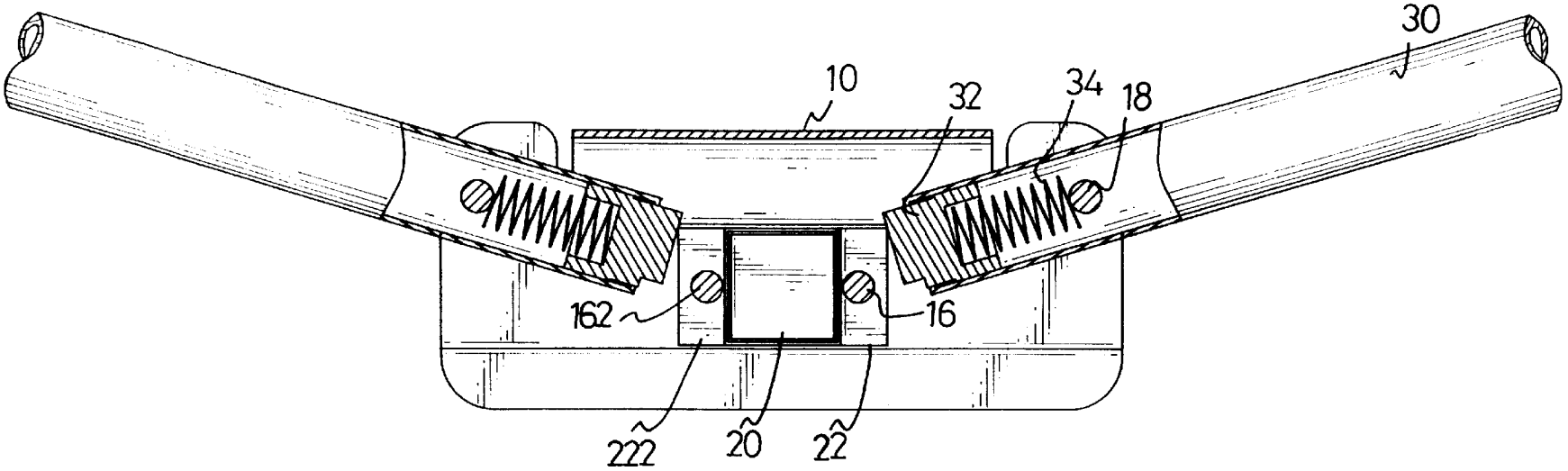
FIG. 6 is a partial sectional view showing the linkages of the joint being opened.

Referring to FIG. 6, when the linkages (30) are extended to the "open" position, they are rotated upward and the plugs (32) will be pressed inward by the wings (22, 222) of the locking means (20) thereby not blocking the rotation. When the linkages (30) are located a horizontal position, the plugs (32) will be pressed back to the original state by the first spring (34) and the planes (322) of the plugs (32) are engaged by the wings (22, 222) of the locking means (20) again.

The advantages of the present invention are:

1. The structure of the joint is simplified so that the cost is lower.
2. The operation is easy since extending the linkages to the "open" position does not require pressing the locking means.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claim is:

1. A foldable joint of a playpen comprising:

a U-shaped body having an opening defined in a side face thereof;

two linkages respectively pivotally mounted on each end of the body by pivot pins each having a plug forming a plane on the bottom thereof provided in the end mounted on the body; and a first spring disposed between the plug and the pivot pin;

a locking means of which the front portion corresponds to the opening, movably mounted in the body by rivets having two wings respectively formed on both sides of the locking means; and a second spring disposed between the back portion of the locking means and the inner wall of the body.

2. The foldable joint of a playpen as claimed in claim 1, wherein the locking means further defines a cavity in the back thereof and receives the second spring in the cavity.

3. The foldable joint of a playpen as claimed in claim 1, wherein the body further defines a channel in the opposite side face from the opening and the wings of the locking means can be received in the channel when pressing the locking means.

* * * * *